US006510625B2

(12) United States Patent
Sato et al.

(10) Patent No.: US 6,510,625 B2
(45) Date of Patent: Jan. 28, 2003

(54) STRUCTURE FOR ATTACHING AND DETACHING ATTACHMENT TO/FROM SHOE SOLE

(75) Inventors: Mitsuo Sato, Otawara (JP); Yoshiki Mishima, 1258-6. Yahashi-cho, Kusatsu-shi, Shiga (JP)

(73) Assignees: Yugen Kaisha Sato Seisakusho (JP); Yoshiki Mishima (JP); Kabushiki Kaisha Daiyu Shoji (KP)

( * ) Notice: Subject to any disclaimer, the term of this patent is extended or adjusted under 35 U.S.C. 154(b) by 0 days.

(21) Appl. No.: 09/815,281

(22) Filed: Mar. 23, 2001

(65) Prior Publication Data

US 2002/0020079 A1 Feb. 21, 2002

(30) Foreign Application Priority Data

Mar. 28, 2000 (JP) ..... 2000-088635
Jul. 12, 2000 (JP) ..... 2000-211149

(51) Int. Cl.[7] ..... A43B 21/36
(52) U.S. Cl. ..... 36/36 R; 36/36 B; 36/134; 36/67 D

(58) Field of Search ..... 36/36 R, 36 B, 36/36 A, 36 C, 41, 42, 134, 67 D

(56) References Cited

U.S. PATENT DOCUMENTS 2,149,893 A * 3/1939 Lehwald ..... 36/36 B
3,351,967 A * 11/1967 Dardig ..... 12/147 R
3,478,447 A * 11/1969 Gilliead ..... 36/36 B

* cited by examiner

*Primary Examiner*—Ted Kavanaugh
(74) *Attorney, Agent, or Firm*—Lorusso & Loud

(57) ABSTRACT

A connector includes an insert member for seating within a socket embedded in a shoe sole wherein it is removably fixed with an elastic member, the connector permitting the removal of the attachment with a wrench engaging a tool fitting portion formed on the shoe sole side. A first camming surface is formed on the socket and a second camming surface is formed on the insert member. The insert member is removed from the socket using a wrench to turn the second camming surface relative to the first camming surface.

9 Claims, 6 Drawing Sheets

STRUCTURE FOR ATTACHING AND DETACHING ATTACHMENT TO/FROM SHOE SOLE

BACKGROUND OF THE INVENTION

1. Field of the Invention

The present invention relates to a connector structure for attaching and detaching an attachment to/from a shoe sole, and it is mainly directed to development of a structure for attaching and detaching a heel of a shoe and a structure for attaching and detaching a spike, etc., provided on a sole portion of an athletic shoe such as a golf shoe for preventing slipping.

2. Prior Art of the Invention

In the field of athletic shoes, the present applicant has already filed an application directed to an attachable and detachable spike having a structure in which an insert member of a spike is inserted into a concave receptacle portion of an attaching base member to be embedded in a desired portion of a sole and the insert member is removably pinched and fixed with an elastic member, and the application has been laid-open under the publication number JP-A-11-89609.

In the above attachable and detachable spike structure, attaching is easy, but detaching requires lifting with something like a nail puller or a pry. A specialized detaching tool has been therefore required, and inconveniently, no conventional wrench can be used. Further, the above structure is not suitable for fitting an attachment that requires positioning on a front or back portion like a heel, and it is impossible to apply the above structure to a heel and a shoe sole.

SUMMARY OF THE INVENTION

It is therefore an object of the present invention to provide a releasable connector for attaching and detaching an attachment to/from a shoe sole, the connector including a hollow cylinder portion embedded in a desired portion of the shoe sole and an insert member pinched and fixed in the hollow cylinder portion with an elastic member, but which is provided with a mechanism allowing the attachment to be easily detached with a detaching tool such as a conventional wrench.

It is another object of the present invention to provide a connector for attaching and detaching an attachment to/from a shoe sole, which attachment can be accurately aligned and fitted to, e.g., a heel portion of the shoe sole, and which can be easily detached.

Means to Solve the Problems

For overcoming the above problems, the present invention provides a connector for releasably attaching an attachment to/from a shoe sole. According to a first aspect of the present invention, there is provided a connector for releasably attaching an attachment to a shoe sole, which structure includes a hollow cylinder portion embedded in a shoe sole and an attachment having an attaching/detaching tool fitting portion formed on the shoe sole side and an insert member to be inserted into the hollow cylinder portion. The insert member is inserted into the concave receptacle portion and inside the concave receptacle portion, and is then removably pinched and fixed with an elastic member.

Third, a gradient surface is formed on either one side of the portion or the insert member, and a copying portion for copying the pushing-up gradient surface is formed on the other side.

The attachment may be turned with an attaching/detaching tool to remove the insert member from the concave receptacle portion.

According to a second aspect of the present invention, there is provided a connector for attaching and detaching an attachment to/from a shoe sole, which includes a hollow cylinder portion embedded in a shoe sole, an insert member having an attaching/detaching tool fitting portion and an attachment pressing flange for holding the attachment against the shoe sole side, the insert member being inserted into the hollow cylinder portion, wherein the attachment has a hole through which the insert member can be inserted.

The insert member is inserted into the hollow cylinder portion through the hole in the attachment receptacle portion, and the insert member is removably pinched and fixed within the hollow cylinder portion by an elastic member.

A first camming surface is formed on one of the hollow cylinder portion or the insert member, and a second camming surface for engaging the first camming surface is formed on the other.

The holding tool is turned with an attaching/detaching tool to remove the insert member from the hollow cylinder portion.

DETAILED DESCRIPTION OF THE INVENTION

Figure 1:
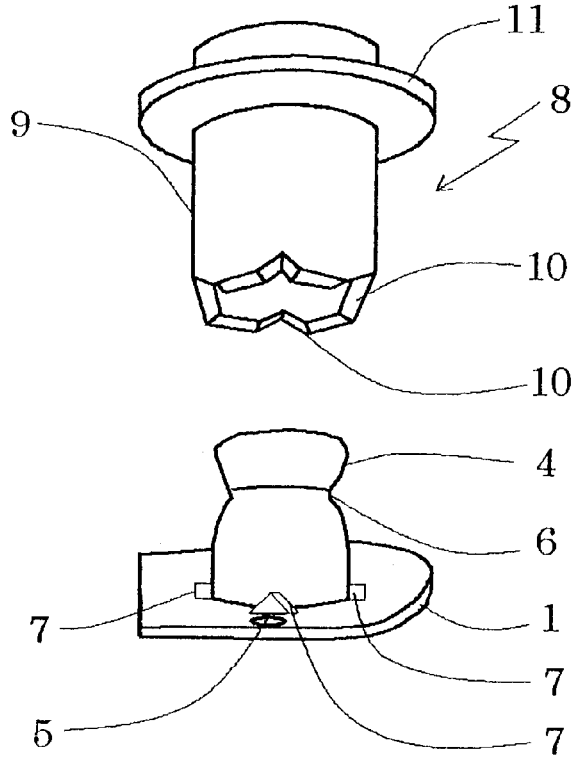
FIG. 1 is an exploded perspective view of a first embodiment in which an t member is formed in a heel sole.
Figure 2:
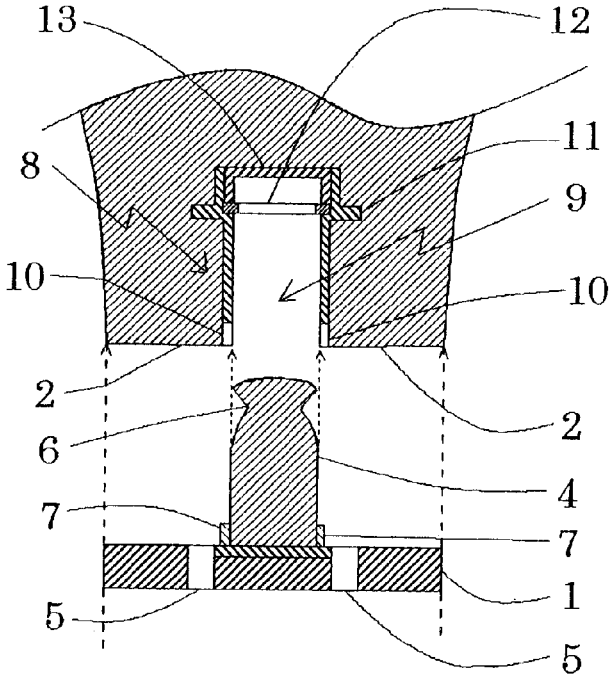
FIG. 2 is an enlarged cross-sectional view of the above first embodiment.
Figure 3:
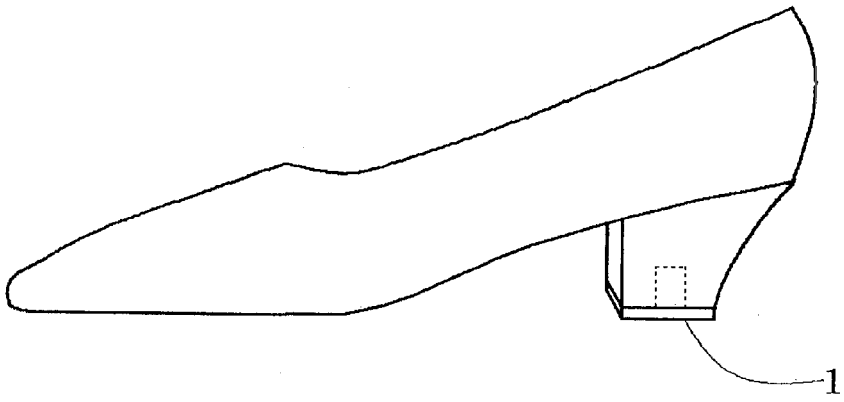
FIG. 3 is a perspective view of a shoe incorporating the present invention.

Embodiments and examples of the present invention will be explained with reference to drawings hereinafter. FIGS.

1 to 3 show a first embodiment of the connector for attaching and detaching an attachment to/from a shoe sole. The present invention can be applied to almost all shoes including athletic shoes, and-the first embodiment is directed to an example in which a heel sole 1 of a shoe for a woman is provided as an attachment.

The connector for attaching and detaching an attachment to/from a shoe sole in the first embodiment has an attaching base member 8 having a hollow cylindrical portion (bushing) 9 and the heel sole 1 that is an attachment having an insert member 4. For example, when the heel sole 1 is a small heel sole such as a heel sole 1 of a shoe for a woman, the heel sole 1 can be fixed directly to a shoe heel with one insert member 4. In the present invention, the bushing 9 may be formed directly in a heel 2, while the first embodiment uses the attaching base member 8 that is separately provided for convenience of production.

The hollow cylindrical portion or bushing 9 into which the insert member 4 of the heel sole 1 is to be inserted is formed in the attaching base member 8 to be embedded in a desired portion of the heel 2, and a spring ring 12 as an elastic member is fitted inside the concave receptacle portion 9 in a fashion in which the spring ring 12 projects inside of the bushing 9.

Four notches are formed in a top end portion (lower end portion in FIG. 1) of the bushing 9, and each of them forms a gradient (first camming) surface 10. The notches are arranged at 90° intervals. When the heel sole 1 has a defined forward and backward and is symmetrical with regard to a front to back central axis two notches may be provided in forward and rear positions. When the heel sole 1 is not thus symmetrical, four notches are formed at intervals of 90 degrees, so that the direction of the insert member 4 can be adjusted by 90 degrees.

The attaching base member 8 is separated into a main attaching base member and a cover member 13 in a position located deeper than the position where the spring ring 12 is fitted inside the bushing 9. As a result, production can employ a method in which the spring ring 12 is separately fitted inside the attaching base member 8 and then the cover member 13 is fitted and tightened to fix it. In the drawings, numeral 11 indicates a flange, and it is formed so that the attaching base member 8 in the heel 2 does not easily come off.

A wrench hole 5 is formed as a tool receiving portion in the heel sole 1, and the insert member 4 which is received in the bushing 9 is fixed to and extends from the heel sole 1. Near the distal end of the insert member 4 is an engaging groove 6 which is removably engaged by the spring ring 12.

The heel sole 1 has mating projections (second camming surface) 7 formed in four places corresponding to the notches of the attaching base member 8. Each projection 7 has a size corresponding to the depth of the notches of the attaching base member 8. The projections 7 do not enter into the deepest portions of the notches but, when the heel sole 1 is turned, the projections 7 slide along the sloped notch surfaces 10 thereby pushing the insert 4 out of the base member 8.

In this embodiment, the heel sole 1 is removably pinched and fixed by inserting the insert member 4 into the bushing 9 of the attaching base member 8 and engaging the spring ring 12 within the engaging groove 6 of the insert member 4. After the insertion, if the insert member 4 is turned to some extent (90 degrees to 180 degrees or less), the projections 7 slide along the notch surfaces 10 so that the insert member 4 enters the bushing 9, and the spring ring 12 becomes engaged within the engaging groove 6 to lock the insert member 4.

For detaching, in a state where the insert member 4 of the heel sole 1 is removably held within the bushing 9 of the attaching base member 8 by the spring ring 12, a wrench is inserted into the wrench hole 5 of the heel sole 1, and the heel sole 1 is turned to cause the projections 7 to slide on the notch surfaces 10, whereby the insert member 4 is pushed outward from the bushing 9, and the heel sole 1 is thereby removed from the bushing 9 of the attaching base member (socket) 8.

Figure 4:
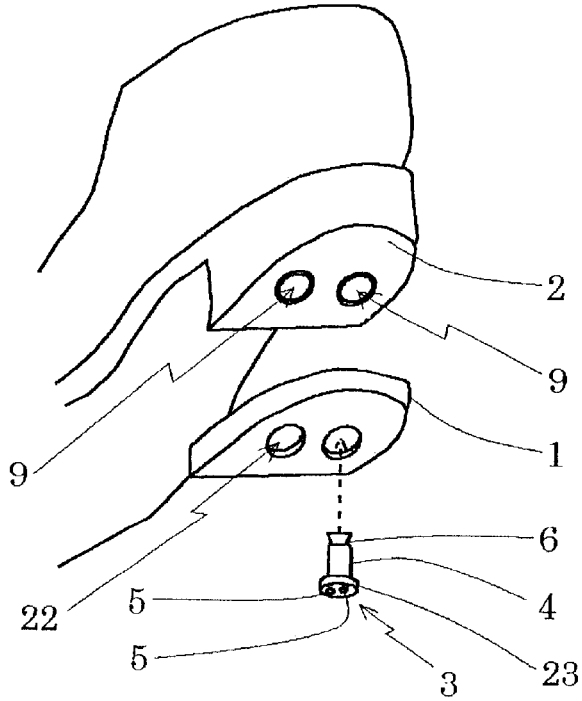
FIG. 4 is an exploded perspective view of a second embodiment in which an insert member is formed in a holding tool.
Figure 5:
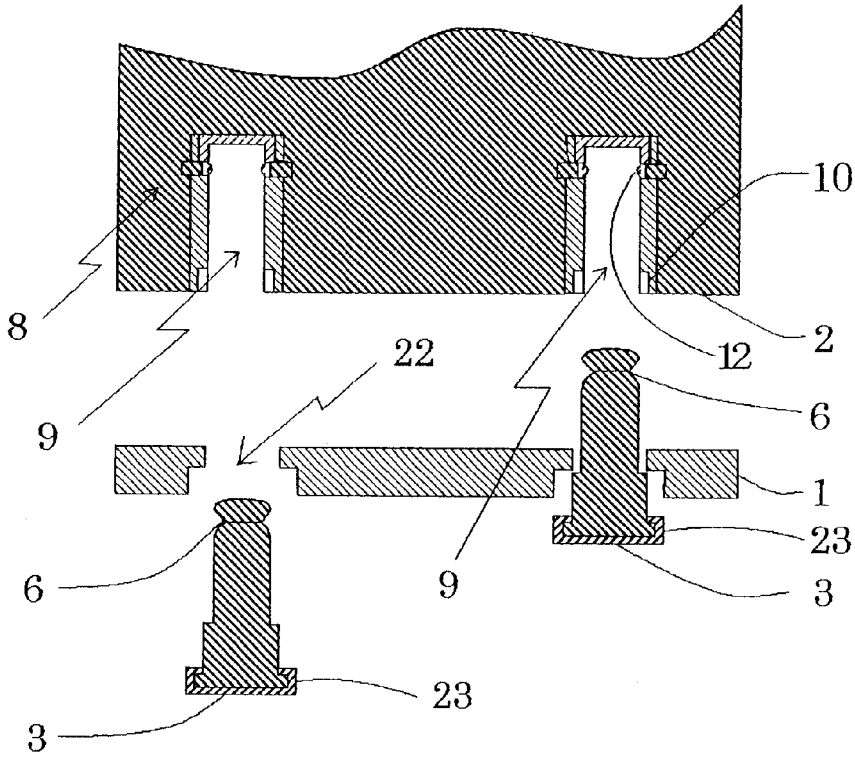
FIG. 5 is an enlarged cross-sectional view of the connector of the above second embodiment.

FIGS. 4 and 5 show a second embodiment. FIG. 4 is an exploded perspective view of the second embodiment in which an insert member 4 is formed on a fixing element 3, and FIG. 5 is an enlarged cross-sectional view thereof. In principle, the second embodiment is similar to the first embodiment, and the second embodiment differs from the first embodiment only in that a heel sole 1 and the fixing element 3 are separate from each other and are two in number. The second embodiment is directed to a heel sole 1 as an attachment to a shoe for a man.

The connector for attaching and detaching the attachment to/from a shoe sole 2 in this embodiment has an attaching base member 8 with two sockets 9, and fixing elements 3, each having an insert member 4, and the heel sole 1 as an attachement. Each of the sockets 9 in the shoe sole 2 holds both a bushing 9' into which the insert member 4 of the fixing element 3 is to be inserted, and a spring ring 12 as an elastic holding member. Four notches are formed in a distal end portion of the bushing 9', and each notch forms surfaces 10 (first camming surface). The notches are arranged at intervals of 90 degrees.

Wrench holes 5 are formed in the fixing elements 3. An engaging groove 6 for removably receiving the spring ring 12 is provided near the distal end portion of the insert member 4. A through hole 22 is made in the heel sole 1 and has a size large enough for the insert member 4 of the holding tool 3 to pass through it, but smaller than flange portion 23.

Projections 7 (second camming surface) on fixing elements 3 are formed in four places corresponding to the notches of the bushing 9'. Each projection 7 has a size corresponding to the depth of the notches of the bushing 9'. The projections 7 are positioned-so that they do not come into deepest portion of the bottom of the notch but, when the heel sole 1 is turned, the projections 7 slide along the notch surfaces 10 to push out insert member 4.

In this embodiment, the heel sole 1 is fixed by the flange portion 23 of the fixing element 3. The fixing element 3 is removably pinched and fixed by inserting the insert member 4 into the socket 9 of the base member 8 and engaging the spring ring 12 within the engaging groove 6 of the insert member 4. For detaching, in a state where the insert member 4 of fixing element 3 is removably pinched and fixed in the socket 9 of the attaching base member 8 by the spring ring 12, a wrench is inserted into the wrench hole(s) 5 of the fixing element 3, and the fixing element 3 is turned to cause the projections 7 to slide on the notch surfaces 10, whereby the insert member 4 is pushed out, the holding tool 3 is released from the socket 9 of the attaching base member 8, and then the heel sole 1 is removed. In this embodiment, the projections 7 are not shown.

Figure 6:
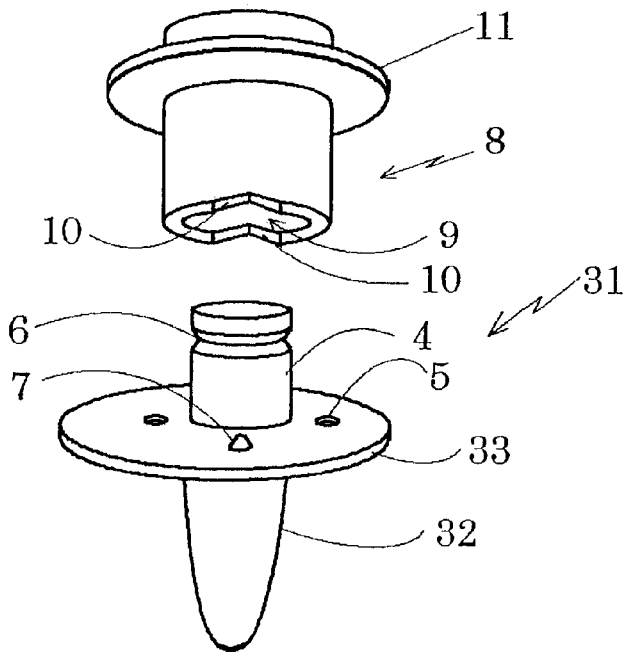
FIG. 6 is an exploded perspective view of a third embodiment directed to a connector for attaching and detaching a spike.
Figure 7:
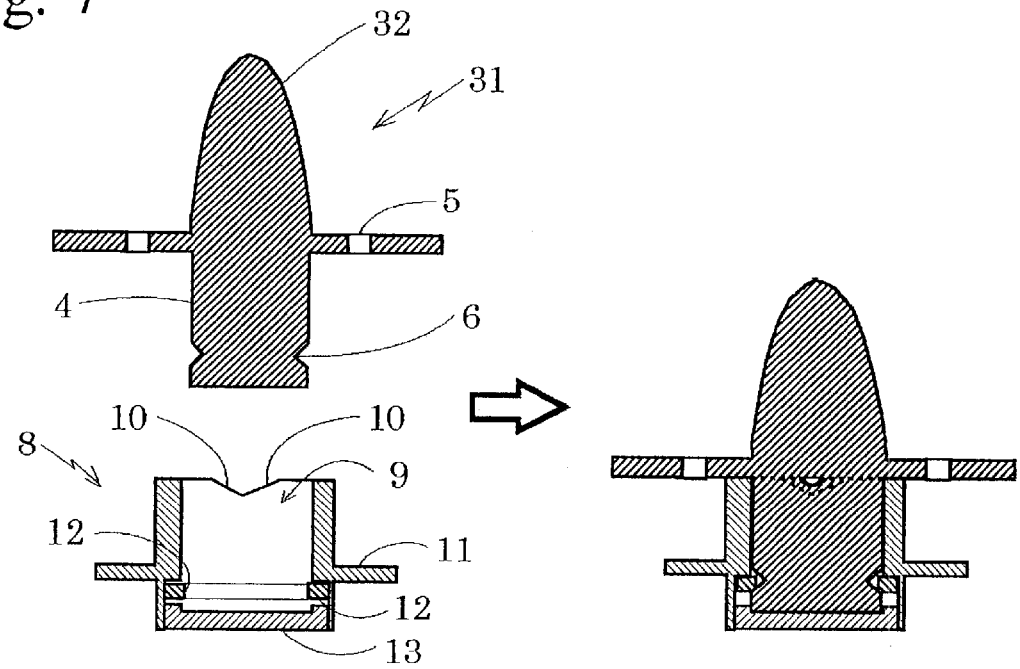
FIG. 7 is a cross-sectional view of the connector of the third embodiment showing the state of attaching the spike.

A third embodiment is directed to a connector for attaching and detaching a spike. FIG. 6 is an exploded perspective view of the connector according to the third embodiment, and FIG. 7 is a cross-sectional view of the connector. The connector has an attaching base member 8 and a spike 31. In the present invention, a socket 9 may be formed directly in the sole of an athletic shoe, but this embodiment uses a socket 9 that is separately provided for the convenience of production.

The socket 9 into which an insert member 4 of the spike 31 is to be inserted is formed in the attaching base member 8 to be embedded in a desired portion of the shoe sole, and a spring ring 12 as an elastic member is fitted inside the socket 9. Notches are formed in two places of a top end portion (upper end portion in FIG. 7) of the socket 9 as a first camming surface, and each notch forms a gradient surface 10.

The attaching base member 8 includes a flange 11, a hollow cylindrical portion (socket) 9 and a separate cover member 13. The cover member 13 holds a spring ring 12 fitted inside the hollow cylinder portion 9. As a result, a production process can employ a method in which the spring ring 12 is fitted inside the hollow cylindrical portion 9 and the cover member 13 is fitted and tightened to fix the spring ring 12. The flange 11 is used to secure the attaching base member 8 to the sole of the athletic shoe.

The spike 31 has a spike pin 32, a flange portion 33 having wrench holes 5 made therein and an insert member 4 to be inserted into the hollow cylinder portion 9. An engaging groove 6 for removably fixing the spring ring 12 is formed near the distal end of the insert member 4.

On a lower surface of the flange portion 33 of the spike 31, mating projections 27 (second mating surface) are provided in two places corresponding to the notches of the attaching base member 8. Each projection 27 has a size corresponding to the depth of the notches of the attaching base member 8. The projections 27 do not come into contact with the gradient surface 10 in the deepest portion of the bottom of the notch but, when the flange portion 33 is turned, the projections 7 slide along the gradient surfaces 10 to push out the insert member 4.

In this embodiment, the spike 31 is removably fixed in place by inserting the insert member 4 into the hollow cylinder portion 9 of the attaching base member 8 and engaging the spring ring 12 within the engaging groove 6 of the insert member 4.

In a state where the insert member 4 of the spike 31 is removably fixed in the hollow cylinder portion 9 of the attaching base member 8 with the spring ring 12, a wrench is inserted into the wrench hole(s) 5 of the spike 31, and the spike 31 is turned to slide the projections 7 on the gradient surfaces 10, whereby the insert member 4 is lifted up, and the spike 31 is removed from the hollow cylinder portion 9 of the attaching base member 8. Like the heel, the spike may also have the insert member 4 and the spike pin 32 formed separately.

Figure 8:
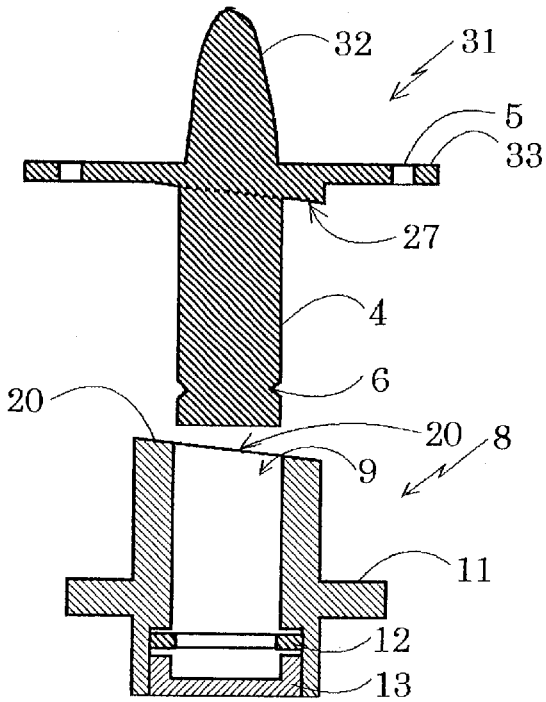
FIG. 8 is an exploded perspective view of a fourth embodiment.

FIG. 8 shows a fourth embodiment, in which a gradient surface 20 is formed by obliquely cutting a distal end portion (upper end portion in FIG. 8) of a hollow cylinder portion 9 to form a first camming surface, and a mating portion second camming surface 27 is formed on a lower surface of a flange portion 33 of spike 31.

Figure 9:
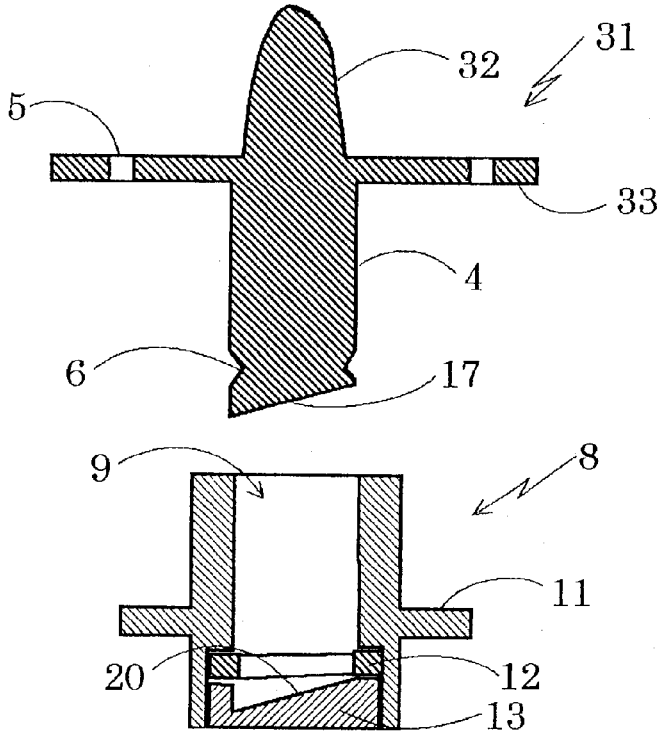
FIG. 9 is an exploded perspective view of a fifth embodiment.

FIG. 9 shows a fifth embodiment, in which a gradient surface 20 is formed as a bottom surface (first camming surface) inside a socket portion 9 and a mating surface 17 (second camming surface) is formed as a gradient surface on an end surface of an insert member 4 of a spike 31.

Figure 11:
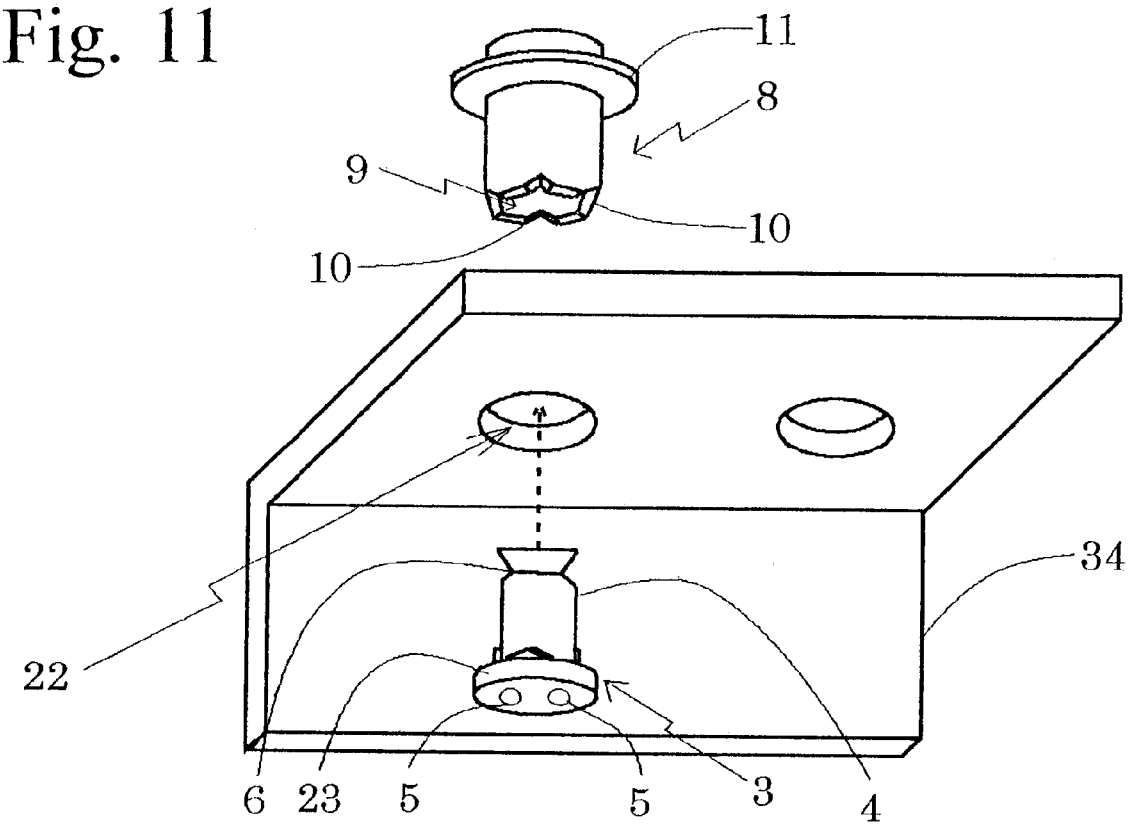
FIG. 11 is a drawing showing the attaching of a spike metal member of a baseball player shoe.

FIG. 11 shows a sixth embodiment directed to a connector for attaching and detaching a metal spike member 34 of a baseball shoe which member is to be fitted to a shoe sole 2 of the baseball shoe. Conventionally, most of metal spike members are fixed with a hexagon headed bolt, and when it is not necessary to replace them, they are sometimes nailed. When the connector of the sixth embodiment is employed, the metal spike members 34 of a baseball shoe can be easily replaced.

In all of the above embodiments, the spring ring 12 is attached in the hollow cylinder portion (socket) 9 of the attaching base member 8 and the engaging groove 6 is formed in the insert member 4. However, the spring ring may be attached to the insert member 4 and the engaging groove 6 formed in an inner wall of the hollow cylinder portion 9 of the attaching base member 8.

In all of the embodiments, the attachments such as the heel sole 1, etc., the insert member 4 and the hollow cylinder portion 9 may be made of metal, may be made of resin or may be made of both. For example, when the attachment is the spike 31 of a golf shoe, metal is used. When the attachment is the shoe sole 2, a resin is suitably used.

Figure 10:
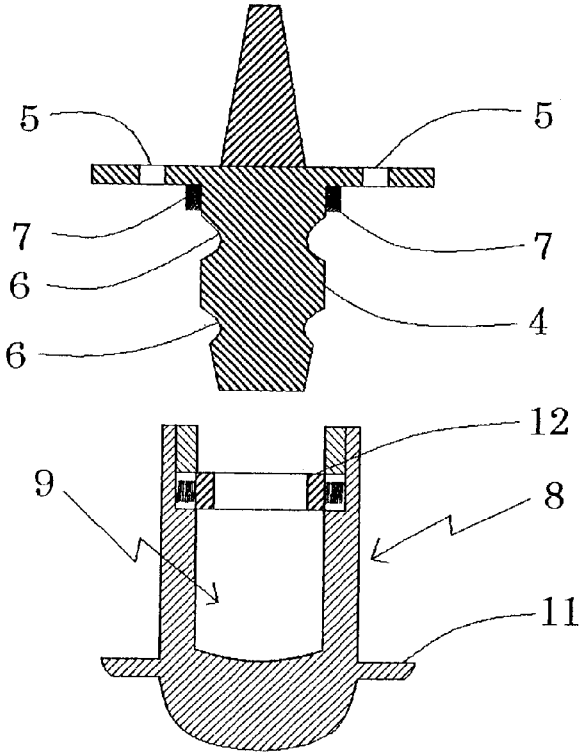
FIG. 10 is a drawing of an insert member having two engaging grooves.

In yet another embodiment, as shown in FIG. 10, engaging grooves 6 for receiving the insert member 4 are provided in two or more places. In this embodiment, even if the insert member 4 becomes unseated in one place, the spring ring 12 engages with another engaging groove 6, so that the insert member 4 does not easily come off.

As Examples of the present invention, structures for attaching and detaching the heel sole 1 and the spike 31 of a golf shoe have been explained, while the attaching and detaching connectors of the present invention can also be applied for attaching and detaching a heel itself, a shoe sole itself, an outer sole of a multi-sole shoe, spikes for a field/track shoes, spikes of football shoes and base ball shoes and non-slip members of snow boots and shoes for sport-fishing or fishing.

The attachment can be easily removed with a conventional wrench since the present invention provides a tool fitting portion formed in the attachment or in the insert member. The first camming surface is formed on the socket side and the second camming is formed on the attachment (holding tool) side. The second camming surface is turned relative to the first camming surface to remove the insert member from the socket.

What is claimed is:

1. A connector for attaching and detaching an attachment to/from a surface of a shoe sole having a cylindrical hole, comprising:

a socket, in the form of a cylindrical sleeve, for being fixed within the cylindrical hole in the shoe sole, said socket containing an elastic member and presenting an annular end face contoured to form a first camming surface;

an insert member for securing the attachment to the shoe sole, said insert member seating within said socket wherein said insert member is removably fixed by said elastic member, said insert member having a second camming surface for engaging said first camming surface;

means for turning said insert member relative to said socket and for causing the second camming surface to slide on the first camming surface, thereby pushing the insert member outward from the socket and detaching the attachment from the shoe sole.

2. The connector of claim 1 further comprising a cover member, said elastic member being fitted within said cylindrical sleeve and fixed in place by the cover member fitted to the cylindrical sleeve.

3. The connector of claim 2 wherein said annular end face has at least one notch forming said first camming surface and wherein said second camming surface is formed as at least one projection which extends within said one notch.

4. The connector of claim 2 wherein said annular end face is cut obliquely relative to the surface of the shoe sole to form said first camming surface and said second camming surface is an oblique surface of an annular portion surrounding and fixed to said insert member.

5. The connector of claim 1, wherein the attachment is a heel of a shoe or an outer sole of a multi-sole shoe.

6. The connector of claim 1, wherein the attachment is a spike.

7. The connector of claim 1, wherein said elastic member is a ring spring.

8. The connector of claim 1 wherein said attachment is integral with said insert member.

9. The connector of claim 1 wherein said insert member has an annular groove which receives said elastic member when said insert is fully seated within said socket.

* * * * *